United States Patent [19]

Bolt

[11] 4,279,144

[45] Jul. 21, 1981

[54] TESTING VENTILATED CIGARETTES

[75] Inventor: Reginald C. Bolt, London, England

[73] Assignee: Molins Limited, London, England

[21] Appl. No.: 70,726

[22] Filed: Aug. 29, 1979

[30] Foreign Application Priority Data

Sep. 1, 1978 [GB] United Kingdom ..... 35318/78

[51] Int. Cl.[3] ..... G01N 15/08

[52] U.S. Cl. ..... 73/38; 73/41

[58] Field of Search ..... 73/38, 41, 45, 45.1

[56] References Cited

U.S. PATENT DOCUMENTS

| | | | |
|---|---|---|---|
| 4,127,025 | 11/1978 | Mills et al. | 73/38 |
| 4,154,090 | 5/1979 | Heitmann et al. | 73/38 |
| 4,171,635 | 10/1979 | Calleson et al. | 73/38 |
| 4,177,670 | 12/1979 | Heitmann et al. | 73/38 |

*Primary Examiner*—Gerald Goldberg
*Assistant Examiner*—Joseph W. Roskos
*Attorney, Agent, or Firm*—Craig and Antonelli

[57] ABSTRACT

Cigarette testing system for cigarettes having perforations 6 in the filter in which the cigarette 2 is surrounded by a suction chamber 8 and the tobacco end is connected to a source of pressurized air. The pressure at the tobacco end is regulated in accordance with the average signal from a transducer 10 at the filter end so as to maintain zero average pressure at the filter end, i.e. so that the air flow into the cigarette from the tobacco end exactly balances the outflow through the perforations. The tobacco end pressure is monitored as a measure of the average dilution level of the cigarettes and the deviations from zero pressure at the filter end can be used as individual cigarette test signals.

14 Claims, 2 Drawing Figures

TESTING VENTILATED CIGARETTES

Figure 1:
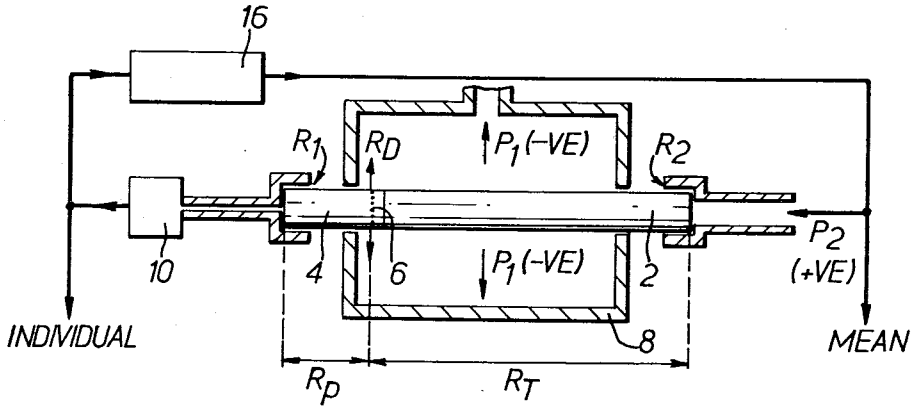

This invention relates to cigarette inspection devices, and particularly to inspection devices adapted to test the dilution of "ventilated" cigarettes, i.e. cigarettes which are manufactured in such a way that the smoker inhales a high proportion of air each time he draws on the cigarette. For example, the cigarette may be provided with perforations in the wrapper of the filter.

It is difficult to measure the degree of ventilation achieved in the manufacturing process with conventional inspection devices, in which the cigarette is surrounded by a suction chamber, because it is necessary to compensate for the resistance to air flow of the filter plug, so as to isolate the component of air flow due to the perforations.

In accordance with the present invention there is provided a method of testing ventilated filter cigarettes comprising surrounding the wrapper of each cigarette in turn, with an axially extending suction chamber; connecting the tobacco end of the cigarette to a source of positive pressure; connecting the filter end of the cigarette to a transducer; and controlling the pressure at the tobacco end of the cigarette so that the mean pressure at the filter-end transducer is zero. Preferably the pressure at the tobacco end is controlled by means of a null-seeking servo connected to the filter-end transducer via a signal integrating device, the servo being arranged to drive a pressure regulator in the pressure line connected to the tabacco end. It will be appreciated that "suction" and "positive pressure" are interchangeable in this context, and it is to be understood that the pressure differences could be reversed in any of the arrangements described.

The mechanical arrangements for transporting and enclosing the cigarettes in the test position may for example be as shown in Disclosure No. 17,743 in the January 1979 issue of Research Disclosure, which is published monthly in Great Britain and which shows a modified version of the MOLINS C.I.D including means for connecting a transducer to each end of the cigarette in the test position, rather than to just one end as in the standard C.I.D.

Thus the invention also extends to cigarette testing apparatus including means for successively transporting cigarettes to a test position; means for forming an enclosed chamber around the wrapper of the cigarette in the test position, the chamber being adapted for connection, in use, to a source of suction at a pressure P1; means for connecting the filter end of the cigarette at the test position to a pressure transducer; means for forming an average P0 of the pressure at the filter end over a number of cigarettes; means for connecting the tobacco end of the cigarette to a pressure regulator which is adapted for connection, in use, to a source of positive pressure; the filter end transducer and the pressure regulator being connected via control means adapted to regulate the pressure P2 at the tobacco end of the cigarette in accordance with the average pressure at the filter end so as to maintain the average pressure at zero; and means for indicating the value of the pressure at the tobacco end. The transducer at the filter end may in addition be arranged to provide signals corresponding to each individual cigarette, so as to allow single cigarette testing.

A preferred form of apparatus in accordance with the invention, includes means for periodically applying a standardisation signal to the pressure indicating means at the tobacco end by applying a pressure difference to it which corresponds to the difference between the pressure in the suction chamber and the regulated pressure at the tobacco end (i.e. P1−P2). It can be shown that the total dilution of the cigarette is a series of dots extending to the formula. −P2/(P1−P2) when the apparatus has adjusted itself to the condition P0=0, and in the preferred arrangement, the pressure indicating means is arranged to adjust itself so as to give an indication of "1" when the standardising signal is applied to it, so that subsequently the indicating device will show a reading corresponding to −P2 (because the reading corresponds to total dilution which equals =P2/(P1−P2) and P1−P2 is arranged to correspond to "1").

Preferably the pressure indicating means comprises a transducer: a multiplying digital-to-analogue converter; an up-down counter arranged to control the multiplying factor of the DAC; and a voltmeter driven by the D.A.C. In the preferred embodiment of the invention the up-down counter is connected to a standardisation pulse generator and to the output of the D.A.C. in such a way that when the standardisation pulse is applied, the counter counts up or down as necessary in order to set the output of the D.A.C. to "1".

Figure 2:
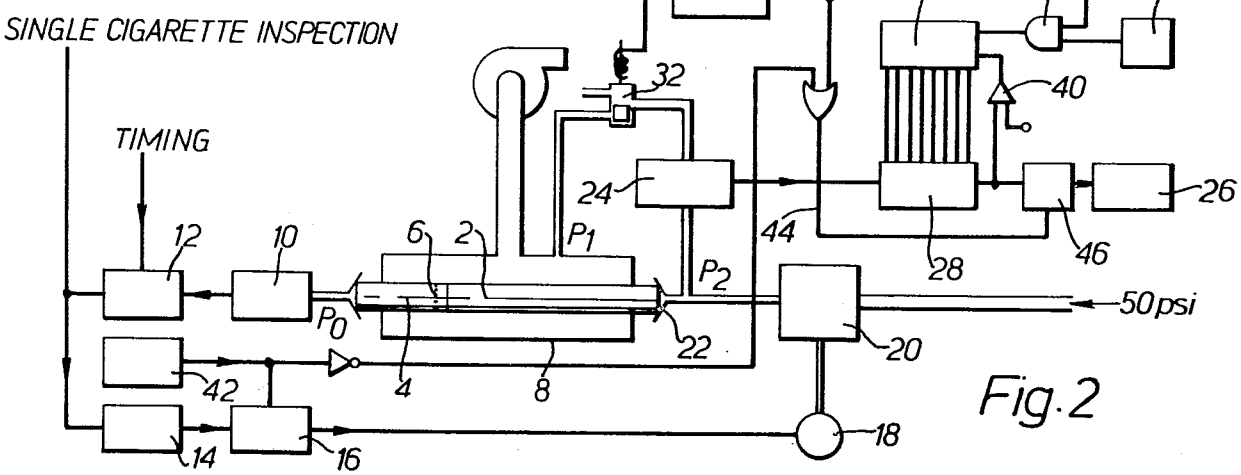

Some embodiments of the invention will now be described by way of example with reference to the accompanying drawings, in which:

FIG. 1 is a simplified explanatory diagram of a system in accordance with the invention; and FIG. 2 is a more detailed diagram of a practical system based on the FIG. 1 arrangement.

FIG. 1 illustrates a testing arrangement for a cigarette 2 having a filter 4 with ventilation holes 6 near the junction with the tobacco column. The major portion of the cigarette, including the ventilation holes 6, is surrounded by a suction chamber 8 which is connected to a source of suction at a pressure P1. The tobacco end of the cigarette is connected to a source of positive pressure P2 which is variable, as will be explained below, and the filter end is connected to a transducer. A null-seeking servo 16 is connected between the transducer 10 and the pressure source P2 and is arranged to vary P2, in operation, so that the average pressure at the filter end is zero.

Then, let plug resistance=Rp tobacco resistance=Rt dilution (i.e. ventilation Hole) resistance=R1

Plug end seal resistance=R2

P2 is arranged to be a low resistance source so the effect of R2 is negligible. P2 is adjusted for zero average pressure at the transducer 10, so that the resistance R1 has no effect.

The ratio of the amount of air normally admitted by the perforations 6, to the flow through the tobacco column will be the inverse of the ratio of their resistances, i.e. will be RT/RD (called "added dilution"). The total air flow through the cigarette is P1/RD which must be equal to P2/RT (because filter end pressure is made equal to zero). Thus RT/RD=−P2/P1=added dilution.

The "total dilution" is defined as the ratio of the amount of air admitted by the perforations, to the total flow in use, and thus corresponds to $-P2P1/(1-P2P1)=-P2/(P1-P2)$ FIG. 2 shown a more practical arrangement for achieving a continuous readout of total dilution, as well as providing signals indicative of individual cigarette defects. The transducer 10 connected to the filter end of the cigarette is arranged to have a fast response, and its output is gated by a strobe 12 fed by a suitable timing pulse. This output can be used for individual cigarette inspection purposes, and is also fed to an integrator 14 which is connected to a null-seeking servo 16. The servo operates a motor 18 which controls a pressure regulator 20 in a line connecting the tobacco end seal 22 to a 50 p.s.i. pressure source. This arrangement sets the pressure P2 at the tobacco end seal to a level such that the average pressure P0 at the filter end is zero, and the pressure P2 is measured by a transducer 24 connected to a digital voltmeter 26 via a digital-to-analogue converter 28 which is used to provide a "scale factor" for the DVM in the following way: a standardisation pulse generator 30 is arranged to operate for five seconds every ten minutes and produces a pulse which operates a three-way valve 32 so as to connect one side of the transducer 24 to the suction chamber pressure P1, the other side still being connected to the regulated tobacco end seal pressure P2. Thus the transducer produces an output corresponding to (P1−P2).

At the same time a pulse is applied to an up-down counter 34 via an AND-gate 36 enabled by a clock pulse generator 38. This causes it to count in a direction which is determined by the sense of a signal applied to its U/D terminal, the signal being derived from a comparator 40 which has one input connected to a one-volt reference source and the other connected to the analogue output of the D.A.C. The binary input lines of the D.A.C. are connected to the corresponding "bits" in the up-down counter, so that as the counter counts up or down, the multiplying factor of the D.A.C. is varied until the analogue output of the D.A.C. is one volt. Thus when the standising pulses are removed, the scale factor of the indicating circuit remains set so that an indication of one volt on the DVM corresponds to the value (P1−P2). Since the transducer 24 supplies a signal P2 outside the standardising period, the indication of the D.V.M. then corresponds to −P2/(P1−P2), which is the "total dilution".

In the event that a cigarette is missing from the flow into the testing device, an optical cigarette detector 42 is arranged to supply a signal on line 44 to the "hold" terminal of a sample-and-hold circuit 46, connected between the DAC and the DVM, so that the previous DVM indication is maintained until the next cigarette appears at the testing station. This "hold" line is also actuated during the standardisation period so that the DVM reading does not actually change to 1.0 volts (otherwise an operator might be misled into thinking that a fault had developed).

I claim:

1. A method of testing ventilated filter cigarettes comprising surrounding the wrapper of each cigarette in turn, including the ventilated area, with an axially extending, substantially enclosed, chamber at a predetermined pressure; connecting the tobacco end of the cigarette to a source of variable pressure; connecting the filter end of the cigarette to a transducer; controlling the pressure at the tobacco end of the cigarette so that the mean pressure (over a number of cigarettes) at the filter end transducer is zero; and measuring the said pressure at the tobacco end.

2. Apparatus for testing ventilated filter cigarettes comprising means for successively transporting cigarettes to a test position; means for forming an enclosed chamber around the cigarette in the test position, the chamber being adapted for connection, in use, to a pressure source; pressure transducer means adapted for connection to the filter end of the cigarette at the test position, the said pressure transducer means including signal averaging means; a variable pressure source adapted for connection to the tobacco end of the cigarette; control means connected to the said pressure transducer means and adapted to vary the pressure at the tobacco end of the cigarette so as to maintain the average pressure at the filter end (over a number of cigarettes) at zero; and means for measuring the pressure at the tobacco end, to provide a measure of dilution.

3. Apparatus as claimed in claim 2 in which the signal averaging means comprises an integrator and the control means comprises a null-seeking servo, and a pressure regulator driven by the said servo.

4. Apparatus as claimed in claim 2 or claim 3 in which the said pressure transducer means includes means for providing pressure signals corresponding to each individual cigarette so as to facilitate the rejection of individual cigarettes with faults.

5. Apparatus as claimed in claim 4 further comprising means for periodically applying a standardisation signal to the pressure measuring means at the tobacco end, the said standardisation signal comprising a pressure difference equal to the difference between the regulated pressure at the tobacco end, and the pressure in the enclosed chamber; and means for adjusting the said measuring means so as to give an output of unity when the said standardisation signal is applied, whereby the measuring means will subsequently give an output which corresponds to the "total dilution" of each cigarette, as herein defined.

6. Apparatus as claimed in claim 5 in which the said measuring means includes signal indicating means and comprises: a transducer; a multiplying digital-to-analogue converter driven by the transducer; an up-down counter arranged to control the multiplying factor of the digital-to-analogue converter; a voltmeter driven by the digital-to-analogue converter; and standardisation pulse generator means which is arranged to supply pulses to the up-down counter during the standardisation signal period; the arrangement being such that the counter will then vary the multiplying factor of the digital-to-analogue converter till its analogue output is equal to unity.

7. A method of testing ventilated filter cigarettes comprising applying a first pressure to the tobacco end of the cigarette, applying a second pressure to surround the cigarette wrapper including the ventilated area, monitoring the pressure at the filter end and adjusting the first pressure to maintain a predetermined pressure condition at the filter end, whereby the first pressure is indicative of the dilution of the cigarette.

8. A method of testing ventilated filter cigarettes according to claim 7 comprising surrounding the wrapper of each cigarette in turn, including the ventilated area, with an axially-extending, substantially-enclosed chamber and applying the second pressure to the chamber.

9. A method of testing ventilated filter cigarettes comprising applying different pressures respectively to the tobacco end and around the wrapper of each cigarette in turn, controlling one of the said pressures in response to the pressure at the filter end averaged over a plurality of successive cigarettes to maintain the mean pressure at the filter end substantially constant, and measuring the said controlled pressure.

10. A method of testing ventilated filter cigarettes comprising connecting the tobacco end of each cigarette in turn to a source of variable pressure while the wrapper of the cigarette, in the ventilated area is surrounded by a different pressure, connecting the filter end of the cigarette to a transducer, controlling the pressure at the tobacco end of the cigarette so that the mean pressure (over a number of cigarettes) at the transducer is constant, and measuring the said pressure at the tobacco end.

11. Apparatus for testing ventilated filter cigarettes comprising means for applying a first pressure to the tobacco end of the cigarette, means for applying a second pressure to surround the cigarette wrapper including the ventilated area, means for monitoring the pressure at the filter end and means for adjusting the first pressure to maintain a predetermined pressure condition at the filter end, whereby the first pressure is indicative of the dilution of the cigarette.

12. Apparatus for testing ventilated filter cigarettes according to claim 11 comprising an axially-extending, substantially-enclosed chamber arranged to surround the wrapper of each cigarette in turn, including the ventilated area, and means for applying the second pressure to the chamber.

13. Apparatus for testing ventilated filter cigarettes comprising means for applying different pressures respectively to the tobacco end and around the wrapper of each cigarette in turn, means for sensing the pressure at the filter end and means for averaging the sensed filter end pressure over a plurality of successive cigarettes and means for controlling one of the said different pressures to maintain the mean pressure at the filter end substantially constant, and means for measuring the said controlled pressure.

14. Apparatus for testing ventilated filter cigarettes comprising a source of variable pressure, means for connecting the said source to the tobacco end of each cigarette in turn, means for surrounding the wrapper of the cigarette, in the ventilated area, by a different pressure, means for connecting the filter end of the cigarette to a transducer, means for controlling the pressure at the tobacco end of the cigarette so that the mean pressure (over a number of cigarettes) at the transducer is constant, and means for measuring the said pressure at the tobacco end.

* * * * *